US009707464B2

(12) United States Patent
Vickers

(10) Patent No.: US 9,707,464 B2
(45) Date of Patent: Jul. 18, 2017

(54) GOLF CLUB TRAINING AID AND GOLF CLUB

(75) Inventor: Mark Vickers, Altrincham (GB)

(73) Assignee: PUT4-DOUGH LIMITED, Wilmslow (GB)

( * ) Notice: Subject to any disclaimer, the term of this patent is extended or adjusted under 35 U.S.C. 154(b) by 0 days.

(21) Appl. No.: 14/000,518

(22) PCT Filed: Feb. 21, 2012

(86) PCT No.: PCT/GB2012/050377

§ 371 (c)(1),
(2), (4) Date: Sep. 9, 2013

(87) PCT Pub. No.: WO2012/114091

PCT Pub. Date: Aug. 30, 2012

(65) Prior Publication Data

US 2013/0337930 A1 Dec. 19, 2013

(30) Foreign Application Priority Data

Feb. 21, 2011 (GB) ..... 1102973.3

(51) Int. Cl.
*A63B 57/00* (2015.01)
*A63B 69/36* (2006.01)
*A63B 53/04* (2015.01)

(52) U.S. Cl.
CPC ..... *A63B 69/3676* (2013.01); *A63B 53/0487* (2013.01); *A63B 69/365* (2013.01); *A63B 69/3685* (2013.01); *A63B 2053/0437* (2013.01); *A63B 2053/0441* (2013.01); *A63B 2210/50* (2013.01); *A63B 2225/093* (2013.01)

(58) Field of Classification Search
CPC ..... A63B 69/3676; A63B 53/0487; A63B 69/365; A63B 69/3685
USPC ..... 473/229, 254, 288, 326
See application file for complete search history.

(56) References Cited

U.S. PATENT DOCUMENTS 2,448,904 A * 9/1948 Millner ..... A63B 69/365 473/229
3,215,436 A * 11/1965 Carter ..... A63B 69/3661 264/54
3,614,108 A * 10/1971 Garten ..... A63B 69/365 473/229
4,136,877 A 1/1979 Antonious
4,919,433 A * 4/1990 Millat ..... A63B 69/3676 473/258

(Continued)

FOREIGN PATENT DOCUMENTS

WO 9300971 A1 1/1993

OTHER PUBLICATIONS

International Search Report for PCT/GB2012/050377 dated May 30, 2012.

*Primary Examiner* — Aarti B Berdichevsky
*Assistant Examiner* — Christopher Glenn
(74) *Attorney, Agent, or Firm* — Shumaker, Loop & Kendrick, LLP

(57) ABSTRACT

A user swings a putter head (154) that is connected to a putter shaft (156) about a pivot of a pendulum (24). The putter head includes an opening (190) and a lower marker (186) located beneath the opening and spaced from the opening. The user attempts to maintain the marker within the opening (190) when swinging the club.

11 Claims, 6 Drawing Sheets

(56) References Cited

U.S. PATENT DOCUMENTS

| | | | | |
|---|---|---|---|---|
| 5,139,264 | A * | 8/1992 | Wootten | A63B 21/023 473/229 |
| 5,188,367 | A * | 2/1993 | Gipe | A63B 24/0003 473/229 |
| 5,489,097 | A * | 2/1996 | Simmons | A63B 53/0487 473/326 |
| 6,855,065 | B1 * | 2/2005 | Hamilton | A63B 69/3685 473/229 |
| 7,568,979 | B2 * | 8/2009 | Arnold, Jr. | A63B 69/0057 473/227 |
| 7,731,600 | B1 * | 6/2010 | Diesterheft | A63B 53/007 473/254 |
| 2001/0011042 | A1 * | 8/2001 | Roark | A63B 53/02 473/288 |
| 2002/0165037 | A1 | 11/2002 | Stitz | |

* cited by examiner

GOLF CLUB TRAINING AID AND GOLF CLUB

BACKGROUND

The present invention relates to golf clubs, a method of using golf clubs and to golf training aids and in particular golf training aids for improving a golfers putting stroke and, more particularly, to golf training aids for facilitating correct positioning of a golfers head relative to the golf ball to be struck.

Improvement of a golfer's swing towards a predetermined preferred method is known to improve the directional accuracy and the accuracy of the length of a golf shot. This is particularly so for the putting stroke. However, even though a golfer may be instructed theoretically and practically on how to perform a determined preferred putting stroke, every golfer will perceive these instructions differently and will not be able to experience how a predetermined preferred putting stroke should physically feel.

SUMMARY

It is therefore desirable for there to be means and a method for enabling golfers to physically experience a predetermined preferred putting stroke.

According to the present invention there is provided a golf training aid comprising a pivot member having pendulum attachment means, the pendulum attachment means being raised above the ground by at least one support leg, and a pendulum having pivot member attachment means, for attachment of the pendulum to the pivot member, and a golf club attachment means.

The golf club attachment means is advantageously disposed at, or adjacent to, the distal end of the pendulum.

The club attachment means may comprise an attachment pin.

The golf training aid advantageously further comprises a head position member extending from the pivot member in a substantially opposite direction to which the pendulum extends such that, in use, it provides correct positioning of the user's head.

The pendulum is advantageously extendable in length and is preferably telescopic.

The golf training aid preferably comprise a pivot member base portion mounted on the at least one leg.

The golf training aid preferably comprises a pivot member stem extending between the base portion and the pivot member.

The pivot member stem is preferably movable along its longitudinal axis, relative to the base portion, to thereby adjust the distance between the base portion and the pivot member.

The base portion may comprise an aperture suitable for receiving a portion of the pivot member stem.

The golf training aid preferably comprises three legs, to form a tripod. The, or each, leg is preferably adjustable in length and is preferably hingedly attached to the base portion.

The golf training aid advantageously further comprises a golf club head having pendulum attachment means for attachment of the club head to the pendulum.

The golf training aid may further comprise a golf club shaft suitable for attachment to the golf club head. The golf club shaft may be adjustable in length. An example of such a shaft may be, for example, a telescopic shaft.

Also according to the present invention there is provided a golf club head having attachment means for attaching the head to the above-mentioned golf training aid.

The attachment means may comprise an attachment hole operable to slideably receive the golf club attachment means, of the training aid, therein. The golf club attachment means and the attachment hole may be shaped to cooperably prevent rotational displacement between the golf club attachment means and the golf club head.

The attachment means, disposed in the club head, is advantageously operable as an interchangeable ballast weight.

The golf club head advantageously comprises a ballast weight hole operable to receive the ballast weight.

The ballast weight and the ballast weight hole are advantageously cooperatively operable to prevent rotation displacement therebetween.

The golf club head advantageously comprises an alignment plate and an alignment marker cooperatively operable to provide a line-of-site indicative of an optimum user head position during a putting stroke.

The alignment plate advantageously comprises an alignment aperture.

The golf club head advantageously comprises shaft linkage for attaching a shaft to the club head and operable to pivot an attached shaft relative to the club head in at least one dimension.

The shaft linkage is advantageously operable to pivot an attached shaft relative to the club head in two dimensions.

The shaft linkage advantageously comprises a double ended clevis joint.

Also according to the present invention there is provided a golf club having a club head as described in the preceding paragraphs.

According to a further aspect of the present invention a golf club includes upper and a lower spaced markers, the markers being located at a lower region of the club with the relative orientation of the upper and lower markers which are spaced from each other being arranged to be monitored by a user of the club.

The upper marker may comprise an opening which opening may comprise an aperture.

The lower marker may comprise a mark.

At least one of the markers may be located on the head of the club and both markers may be so located.

According to a further aspect of the present invention a method of using a golf club including an upper marker and a lower, spaced maker with the markers being located at lower region of the club comprises a user swinging the club and the user monitoring the relative positions of the markers.

The user may monitor the relative locations of the markers and attempt to maintain the relative position of the markers constant.

The present invention includes any combination of the herein referred to features The present invention will now be described in detail with reference to the accompanying drawings in which:

DETAILED DESCRIPTION

Figure 1:
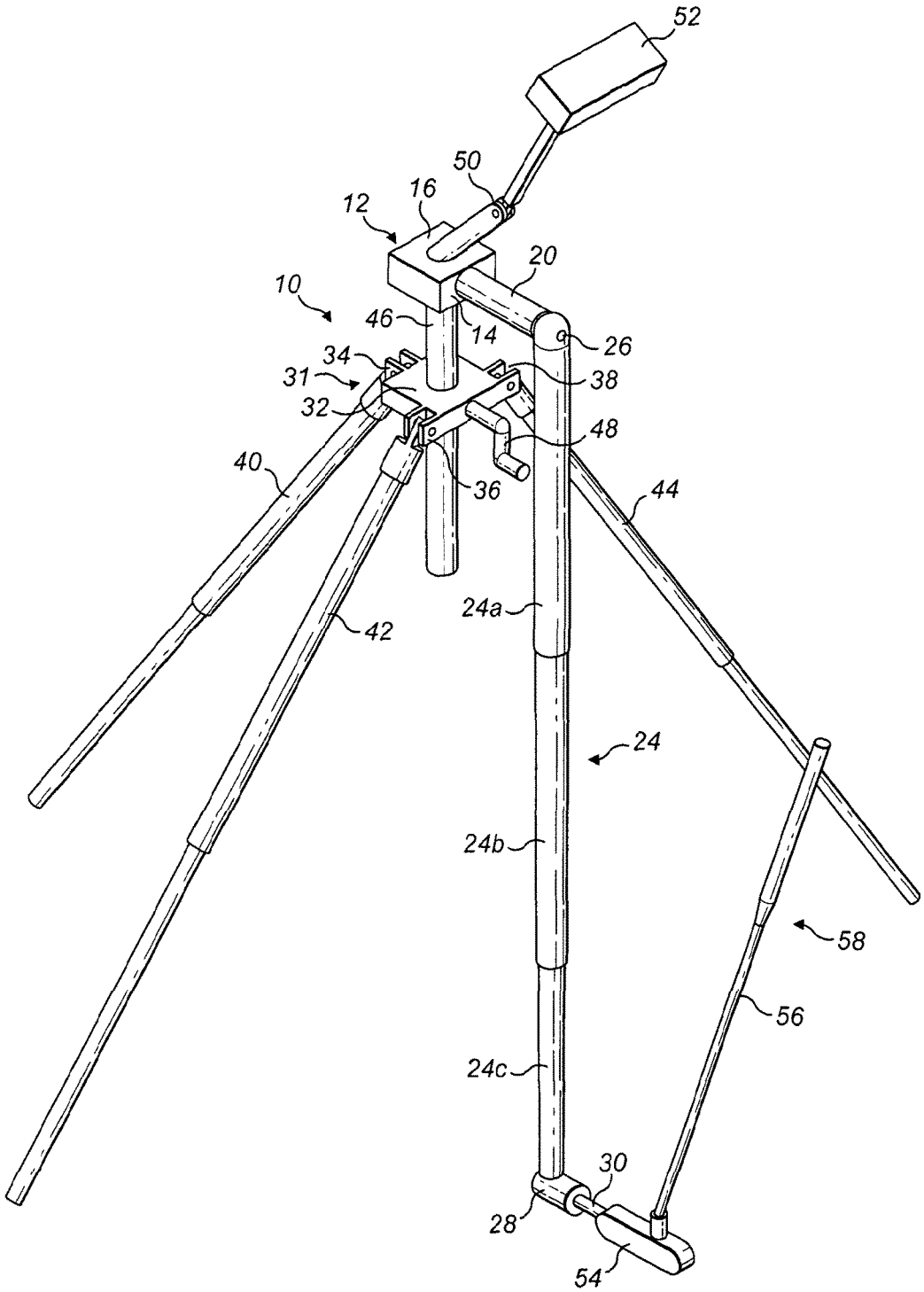
FIG. 1 is an isometric view of a golf training aid according to the present invention.
Figure 2:
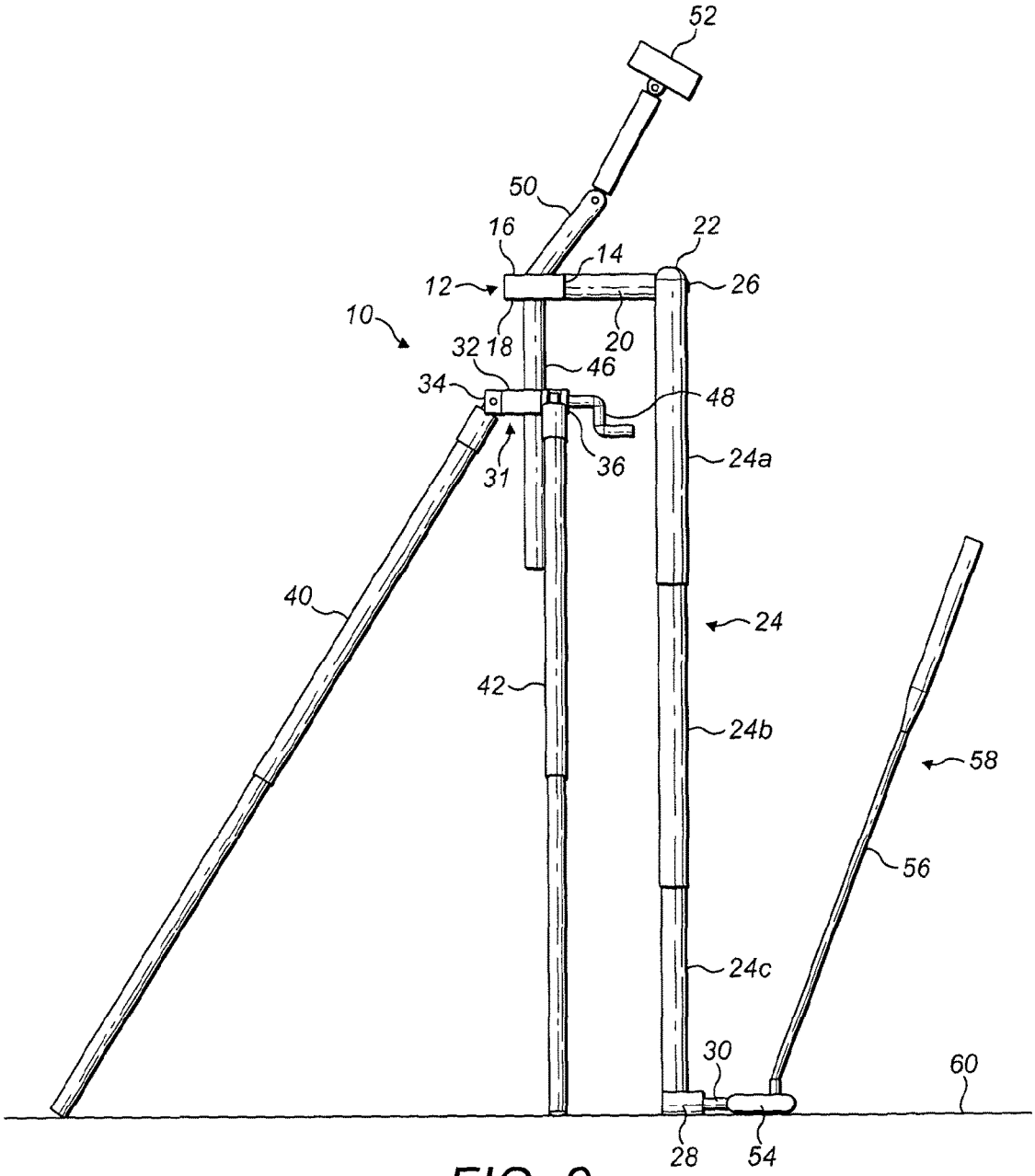
FIG. 2 is a side elevation of the golf training aid of FIG. 1.
Figure 3:
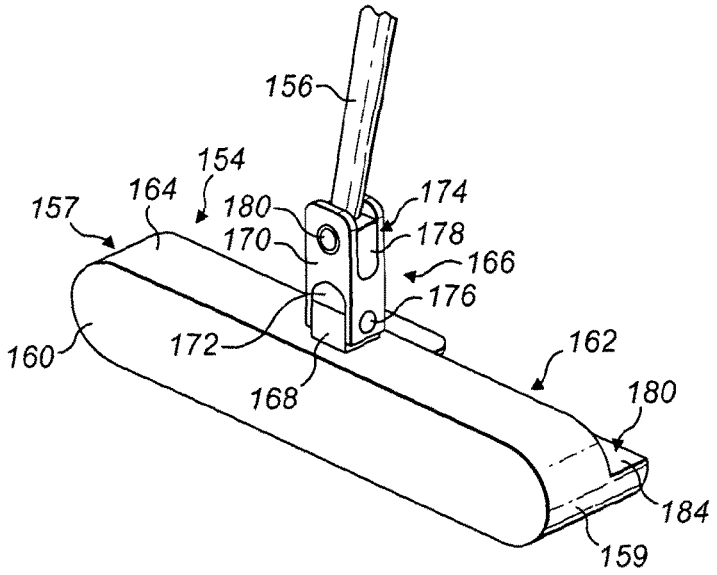
FIG. 3 is an isometric view of a golf putter head according to the present invention.

Referring to FIGS. 1 and 2, a golf training aid 10 according to the present invention has a hub 12 having a side face 14, an upper surface 16 and an under face 18. A pivot member 20 extends outwardly from the side face 14.

On its peripheral end, the pivot member 20 has a pendulum attachment means 22 which may be in the form of either a pivot pin or a suitable hole for receiving a pivot pin. A pendulum shaft 24, formed from an elongate member, has on one end pivot member attachment means 26 and on the other end golf club attachment means 28. The pivot member attachment means 26 may be formed from either a pivot pin or a suitable hole for receiving a pivot pin such that it cooperates with the pendulum attachment means 22. The golf club attachment means 28 has an attachment pin 30. The pendulum 24 is mounted on the pivot member 20 such that the end having a golf club attachment means 28 is able to swing in an accurate or arcuate manner. In a preferred embodiment the pendulum is formed from three telescopic members 24*a*, 24*b* and 24*c* such that it is adjustable in length.

A base portion 31 is formed from a plate 32 having three hinges 34, 36 and 38 spaced apart around the peripheral circumference thereof. Each hinge is connected to a supporting leg 40, 42 and 44, respectively. The supporting legs are telescopic such that their length can be extended to raise the height of the base portion 31 and also to spread their distribution on the ground and account for uneven ground surfaces to provide stability. A spirit level (not shown) may also be disposed on the base 31 to enable the training aid to be correctly set up.

A stem 46 extends downwards from the under face 18 of the hub 12 and through a hole in the base portion 31 such that it is able to pass there through under the control of a worm and wheel mechanism 48. It will be appreciated that other types of mechanism may be used which function to provide control Controlling the worm and wheel mechanism such that the stem 46 moved downwards through the hole in the base portion 31 reduces the height of the pivot member 20 relative to the ground surface. Similarly, controlling the worm and wheel mechanism such that the stem 46 moves in an upwards direction increases the height of the pivot member 20 relative to the ground surface.

An adjustable member 50 extends upwardly in a direction substantially opposite to the direction in which the pendulum extends and has a head position member 52 fixed to its peripheral end. The head adjustable member 50 is angled such as to position the head position member 52 directly above the golf club attachment means 28 and may be adjustable to alter the extent towards and away from a user. The training aid may be operated with or without the adjustable member and the head position member 52.

A specially adapted golf club head 54 may be detachably attachable to the golf club attachment means 28 such that is fixed in position thereto. The golf club head 54 is attachable to the attachment means at different angles such as to provide different angles of loft on the club head face. The loft may range from approximately 0 to 70°. The golf club head 54 may either have a permanently attached shaft 56 or, alternatively, a shaft which is attachably detachable to the golf club head 54 to form a golf club 58. The golf club 58 may be used attached to the golf training aid before being detached therefrom to be used on a golf course.

In use, the golf training aid is set up by extending the legs 40, 42 and 44 to suitable lengths to provide stability. The height of the pivot member 20 is set by adjusting the height of the stem 46 relative to the base 31, by using the worm and wheel mechanism 48. The pendulum 24 is then adjusted in length such that the golf club attachment means 28 overlies the practice putting surface 60 without significantly contracting it. A golf club head 54 is attached to the golf club attachment means 28 such that the shaft 56 extends upwardly in a normal position suitable for practising the putting stroke. The golf club head may be a golf club that can be used in normal play in which case, for example, the toe end of the club head may have attachment means that permit the head to be detachably connected to the golf club attachment means 28. The attachment means on the toe end of the head may be detachable from the head which may allow the club to be more readily used in normal play.

A user grips the golf club 58 in the normal manner before undertaking a putting stroke. In undertaking a putting stroke the club head 54 is guided by the arc which the pendulum determines and draws with the club attachment means 28. This arc is the predetermined preferred arc for undertaking a correct putting stroke. Accordingly, the user experiences the biomechanical feedback in his own body as to how he should be undertaking a putting stroke and also experiences how it should feel.

Referring to FIGS. 3 to 6, a preferred golf club putter head 154 comprises a toe 157, a heel 159, a front ball-striking surface 160, a rear portion 162 and a top surface 164.

The putter head 154 may further comprise shaft linkage 166 for attaching and linking a golf club shaft 156 to the putter head. The shaft linkage 166 has a pivot member 168 fixed to the top surface 164 such that it extends therefrom in a substantially upward direction. The shaft linkage further comprises a double ended clevis joint 170. The double ended clevis joint 170 is a rectangular tube having a first clevis joint 172 disposed at one end and a second clevis joint 174 disposed the other end.

The first clevis joint 172 has an open end which is orthogonal relative to the open end of the second clevis joint 174.

The pivot member 168 is disposed within the open end of the first clevis joint 172 and is pivotably attached thereto by means of a pivot pin 176 which extends through the pivot member 168 and the first clevis joint 172. The pivoting action of the first clevis joint 172 relative to the pivot member 168 may allow the golf club shaft 156 to be pivoted in a forward and backward direction relative the putter head 154 and may thereby allow the angle between the longitudinal axis of the shaft 156 and the plane of the ball-striking surface 160 to be adjusted and fixed at a desired angle—i.e. the loft of the ball-striking surface 160 can be adjusted as desired.

The shaft 156 has a distal end 178 which is disposed within the open end of the second clevis joint 174 and is pivotably attached thereto by means of a pivot pin 180 which extends through the distal end 178, of the shaft, and the second clevis joint 174. The pivoting action of the shaft 156 relative to the clevis joint 170 allows the shaft 156 to be pivoted in a direction perpendicular to the direction of pivot between the first clevis joint and the pivot member. The pivoting action provided by the second clevis joint 174 therefore allows the free end (handle) of the shaft to be pivoted in a plane formed between the toe 157 and the heel 159 and thereby allows the angle of the shaft to be adjusted to suit the height and putting style of the user.

Figure 4:
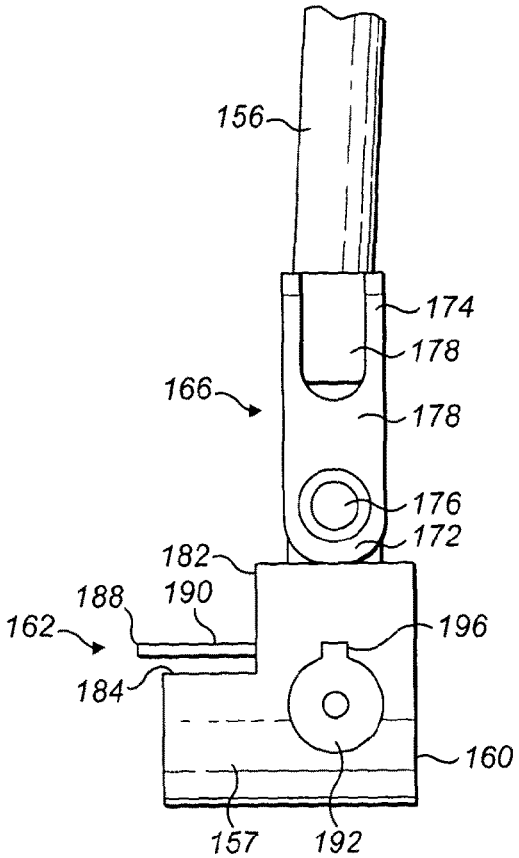
FIG. 4 is drawing of the toe-end view of the golf putter head of FIG. 3.
Figure 6:
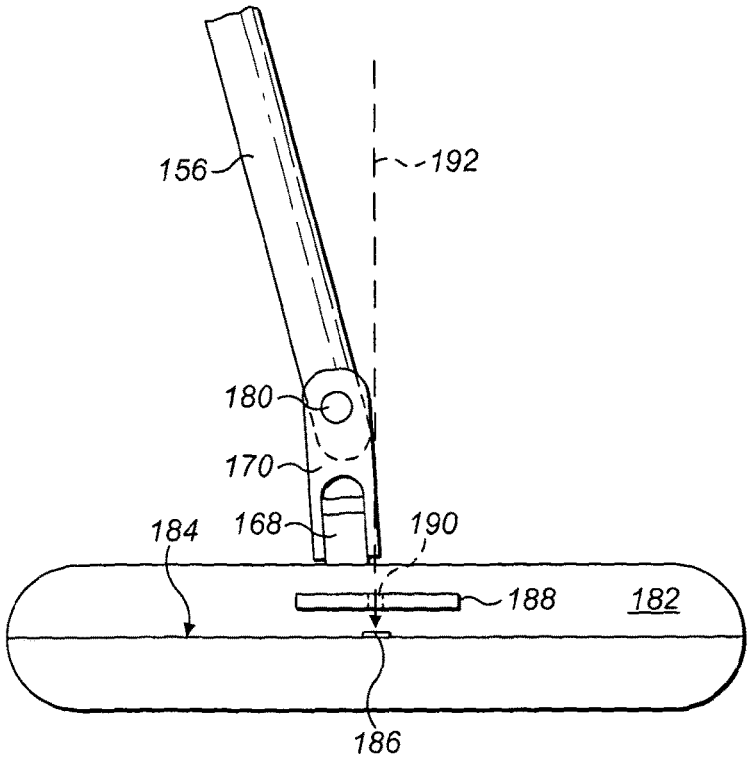
FIG. 6 is a drawing of the rear view of the golf putter head of FIG. 3, and FIGS. 7 and 8 are respectively, a view of one embodiment of a golf club guide in a separated and assembled position.

Referring more particularly to FIGS. 4 and 6, the rear portion 162 comprises a shoulder 180 having an upwardly extending surface such as a substantially vertical surface 182 and a surface transverse thereto such as a substantially horizontal surface 184. Suitably disposed on the surface 184 is a marker 186 and extending outwards such as substantially perpendicularly outwards from the upwardly extending surface 182 in a suitable relationship such as a substantially parallel relationship relative to the horizontal surface 184 is an alignment plate 188. The alignment plate 188 has an alignment aperture 190 extending therethrough such as to provide a preferred line of sight 192 from the user's eye, through the alignment opening which may comprise an aperture 190 to the marker 186. The marker 186 may be, for example, a coloured mark or raised or indented portion disposed on the surface 184. The marker 186 is preferably spaced from the opening 190.

Figure 7:
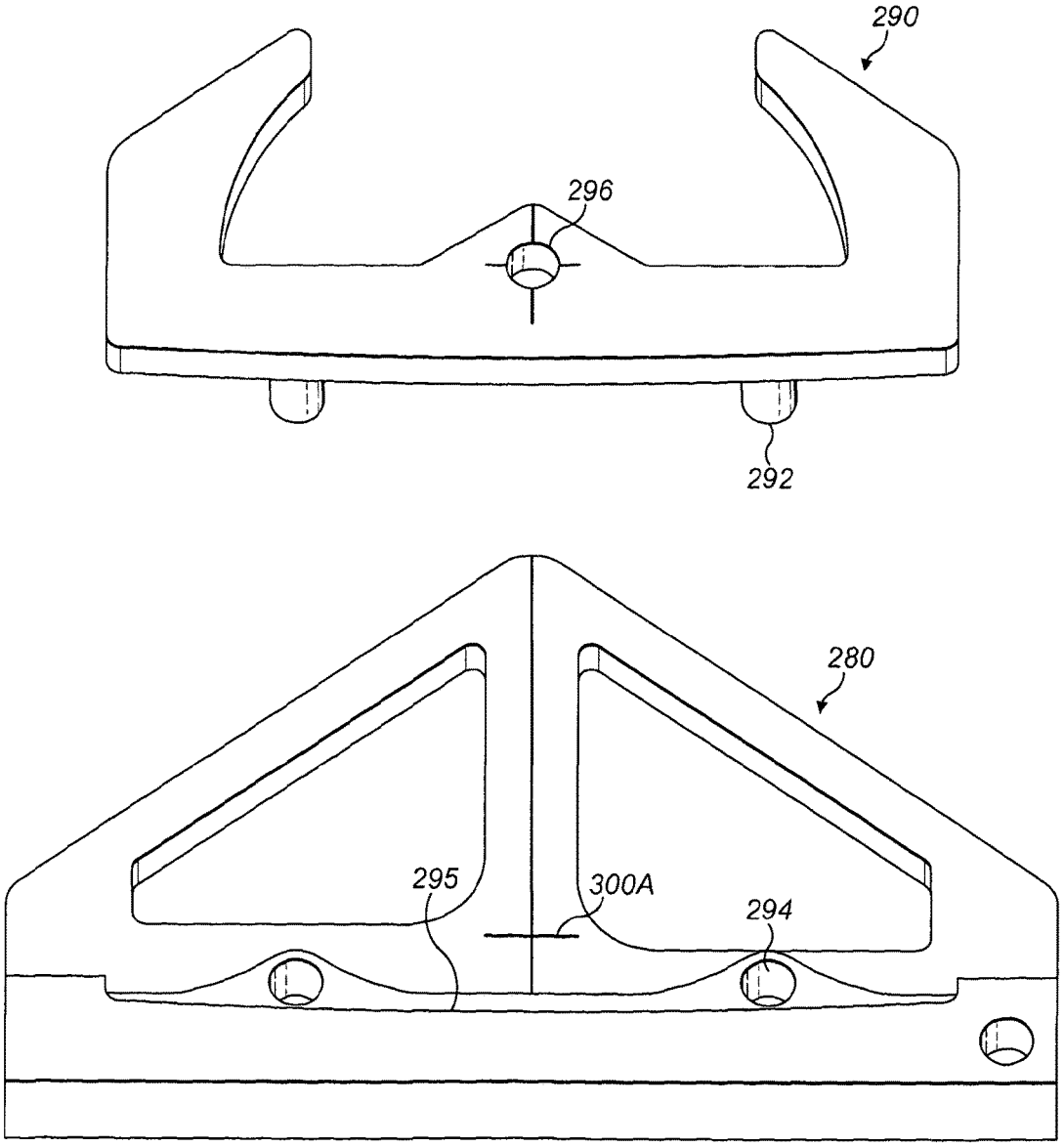
Figure 8:
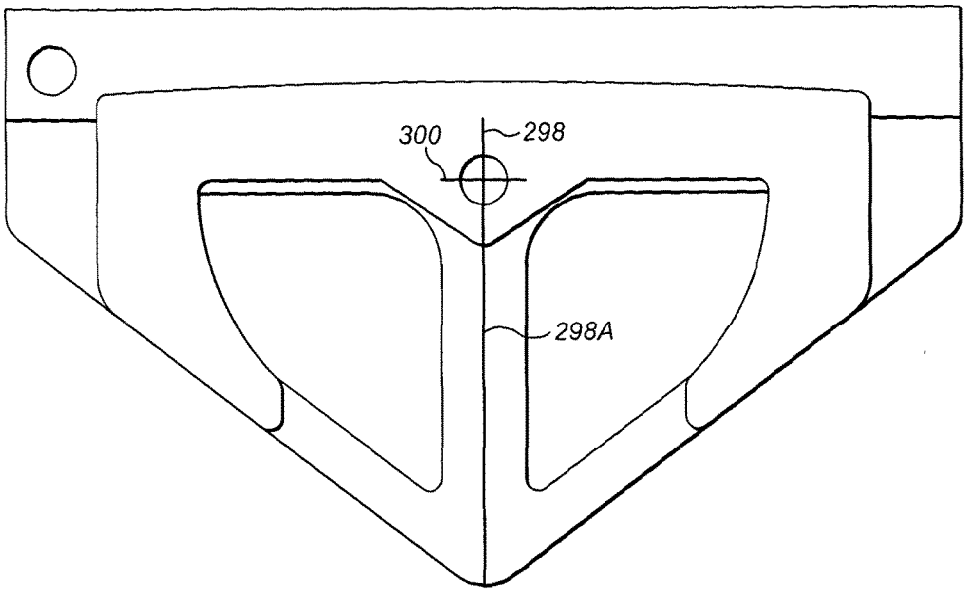

FIGS. 7 and 8 disclose an alternative form of a marker and guide that may be affixed to a club head such as a putter. In this embodiment an upper marker 290 may include downwardly extending spigots 292 that are arranged to be received in aligned openings 294 in a lower marker 280 possibly by being a friction fit therein. The lower marker includes a recess 295 into which the upper marker may fit.

The upper marker 290 includes an aperture 296 which may have a first markings 298 extending in the direction of the intended swing of the club and may have a second marker 300 at right angles to the first marker. The lower marker may have a first marking 298A spaced from the upper marking 298 and may have a second marking 300A at result angles thereto which marker 298A and 300A may cross each other.

In use it is desired to attempt to keep the first marking 298 and 298A aligned with each other as shown in FIG. 8 when swinging the club. It may also be desired to keep the second markers aligned with each other when swinging the club, as shown in FIG. 8.

In accordance with one embodiment of the invention a club is provided having the opening 190 and the marker or the upper and lower marker 290 and 280 which club may or may not be used with the training aid.

In use, the putter head 154 is adjusted relative to the shaft 156, to suite the user, using the shaft linkage 166. The shaft may be adjustable in length such as by comparing telescopic shaft for instance. The user then practices their putting stroke and in doing so maintains the line of sight 192, such that they are able to see the marker 186 through the alignment aperture 190 at all times during the putting stroke. This, along with the training aid allows the optimum putting stroke to be achieved for greater directional and length accuracy.

Figure 5:
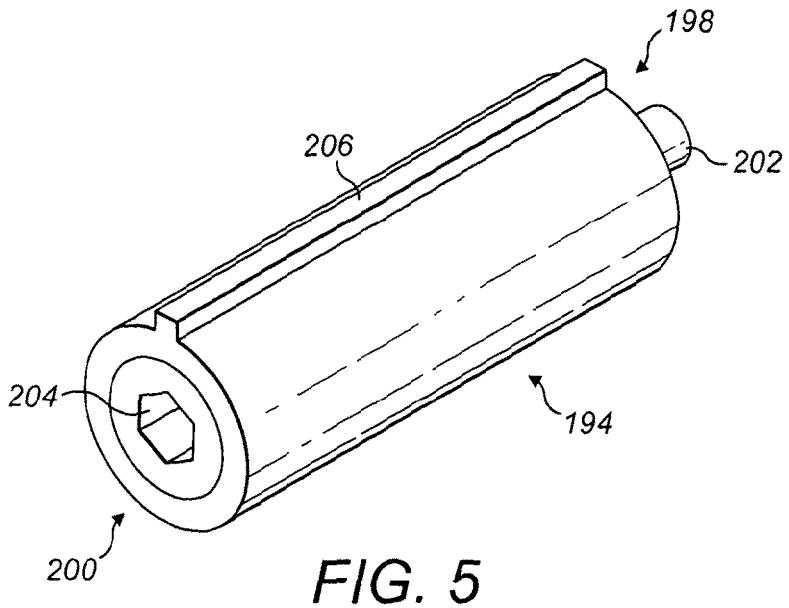
FIG. 5 is an isometric view of a ballast weight for use with the golf putter head of FIG. 3.

Referring to particularly to FIGS. 4 and 5, a ballast hole 192 is formed in the toe 157, of the putter head 154. The hole 192 extends in a direction towards the heel 159 and is shaped to slideably receive and cooperate with a ballast weight 194 (see FIG. 5). The hole 192 has a first diameter for receiving the main body of the ballast weight and a second smaller diameter for receiving an extended portion of the ballast weight. The hole 192 has a circumferentially discrete region of increased diameter extending longitudinally along the length of the hole to provide a receiving groove 196.

The ballast weight 194 provides for adjustable putter weights to suite the user. The ballast weight 194 is a cylinder having an outer diameter which corresponds with the first diameter of the hole 192, such that the weight 194 is slideably received within the hole 192. The weight has an inner end 198 and an outer end 200. The inner end 198 has an extended portion in the form of an alignment projection 202, which extends in the direction of the longitudinal axis of the weight 194 and is dimensioned to have a diameter which corresponds with the second smaller diameter of the hole. The outer end 200, of the ballast weight 194, has an attachment hole 204 extending along the longitudinal axis of the ballast weight 194. The attachment hole 204 is operable to slideably receive the attachment pin 30 of the golf training aid 10 (see FIGS. 1 and 2). The attachment hole 204 is shaped to prevent rotational displacement of the attachment pin 30 relative to the hole 204. Accordingly, the hole 204 has one or more flat portions, which may be machined, and which cooperate with flat portions disposed on the attachment pin 30 to prevent rotation displacement.

The ballast weight 194 also has a raised portion of increased diameter to form a locking member 206, which extends along the outer surface of the weight in a direction substantially parallel to the longitudinal direction thereof. The locking member 206 is dimensioned to be slideably receiving in the groove 196 such that when the weight 194 is disposed within the hole 192 the locking member 206 cooperates with the groove 196 to prevent rotational displacement of the weight 194 relative to the hole 192.

Although the golf training aid, club head and club described above are illustrated in the drawings as suitable for right-handed use, it will be appreciated that the golf training aid, club head and club is equally applicable to left-handed use within the scope of the present invention.

The invention claimed is:

1. A portable putter training aid and a putter in which the portable putter training aid comprises:

a portable base having a plurality of legs that are each connected to a platform, the platform being positioned above each leg, an adjustable support that is received through the platform and between the plurality of legs of the portable base, in which a first end of the adjustable support extends above the platform of the portable base and a second end extends below the platform of the potable base, a pivotally mounted pendulum attached to the first end of the adjustable support extending above the platform, the pendulum pivot adapted for vertical adjustment above the ground by adjustment of the adjustable support and a lower region of the pendulum being arranged in use to be attached to the putter by an a attachment means of the pendulum, a head position member for correctly positioning a head of a user, the head position member being attached to the first end of the adjustable support and being vertically adjustable above the platform of the portable base, and the putter having attachment means for attaching a putter head to the portable putter training aid, wherein:

the attachment means of the putter comprises an attachment hole in the toe of the putter such that the putter is detachable from the portable putter training aid and the toe of the putter is configured to slidably receive the attachment means of the portable putter training aid therein, the attachment means of the putter and the attachment hole are shaped to cooperatively prevent rotational displacement between the attachment means of the putter and the putter head, wherein;

an upper region of the pendulum is configured to rotate about only a single axis such that the lower region of the pendulum has a predetermined arc that varies only in height relative to a surface beneath the portable putter training aid and putter.

2. The portable putter training aid and putter as claimed in claim 1, wherein the attachment means of the putter comprises an attachment pin.

3. The portable putter training aid and putter as claimed in claim 2, wherein each leg is a telescoping leg.

4. The portable putter and training aid as claimed in claim 1, wherein the pendulum is adjustable in length.

5. The portable putter training aid and putter as claimed in claim 4, wherein portions of the support between the first and second end of the adjustable support are configured to selectively raise above and lower below the platform of the portable base.

6. The portable putter training aid and putter as claimed in claim 1, further comprising a shaft suitable for attachment to the putter head.

7. The portable putter training aid and putter as claimed in claim 6, wherein the shaft is adjustable in length.

8. The portable putter training aid and putter as claimed in claim 1, wherein the attachment means of the portable putter training aid is operable as an interchangeable ballast weight.

9. The portable putter training aid and putter as claimed in claim 8, comprising a ballast weight hole operable to receive the ballast weight.

10. The portable putter training aid and putter as claimed in claim 9, wherein the ballast weight and the ballast weight hole are cooperatively operable to prevent rotational displacement therebetween.

11. The portable putter training aid and putter as claimed in claim 1, further comprising an alignment member and an alignment marker cooperatively operable to provide a line of site indicative of an optimum user head position during a putting stroke.

* * * * *